United States Patent [19]

Morgen et al.

[11] 4,019,441

[45] Apr. 26, 1977

[54] WARHEAD ENABLE SWITCH FOR USE IN A MISSILE

[75] Inventors: Melvin Morgen, Rockaway; Richard Herman, Clifton, both of N.J.; Raymond A. Wolski, New Britain, Conn.

[73] Assignee: The United States of America as represented by the Secretary of the Army, Washington, D.C.

[22] Filed: Mar. 8, 1976

[21] Appl. No.: 664,448

[52] U.S. Cl. ..... 102/70.2 R

[51] Int. Cl.[2] ..... F42C 15/40

[58] Field of Search ..... 102/70.2 R

[56] References Cited

UNITED STATES PATENTS

| | | | |
|---|---|---|---|
| 2,897,760 | 8/1959 | Mott-Smith | 102/70.2 R |
| 2,915,013 | 12/1959 | Moorhead, Jr. | 102/70.2 R |
| 3,368,487 | 2/1968 | O'Conner et al. | 102/70.2 R |
| 3,738,273 | 6/1973 | Hoelzen | 102/70.2 R |

*Primary Examiner*—Charles T. Jordan
*Attorney, Agent, or Firm*—Nathan Edelberg; A. Victor Erkkila; Max Yarmovsky

[57] ABSTRACT

An electrically operated warhead enable switch utilizes a dual solenoid drive mechanism in conjunction with a DC lock solenoid mechanism to sense a plurality of unique enable signals and in response thereto permits the driving of a differential which is mechanically coupled to a biased output shaft. The output shaft when rotated a specific number of degrees closes the terminals of a plurality of functioning switches and thereby allows the enabling of a missile's warhead circuitry.

4 Claims, 5 Drawing Figures

WARHEAD ENABLE SWITCH FOR USE IN A MISSILE

GOVERNMENTAL INTEREST

The invention described herein may be manufactured, used and licensed by or for the Government for Governmental purposes without the payment to us of any royalties thereon.

BACKGROUND OF THE INVENTION

Various electro-mechanical means have been used in the prior art to hold a missile in an unarmed state while it was being launched and to arm it after a specific interval of time. The problem with prior art devices was that the isolation switching circuitry, used to isolate the warhead initiating or arming circuitry from the missiles power source, frequently would inadvertently function upon receipt of extraneous electrical signals. The problem with use of DC operated switches or use of standard stepping motors was that they would become operable because of receipt of a spurious electrical signal or could function because of a single short circuit thereby causing the missile to be placed in the intolerable condition of fail-arm. Use of multiphase motors to actuate the enabling switches of a missile is a problem in missile applications because of low holding and operating torque. In missile application, the high stress environments due to spin, pitch, yaw and setback forces can easily overcome the low holding and operating torque of multi-phase motors thus causing a malfunction.

SUMMARY OF THE INVENTION

The present invention relates to a warhead enable switch that can be used in missiles having high stress environments. The present device is not sensitive to spurious electrical inputs and can only be operated by a plurality of unique input signals. The present warhead enable switch permits a missile to be held in either a reset or an armed position with sufficient torque being given to a rotary switch to assure reliable operation.

An object of the present invention is to provide a warhead enable switch that can perform reliably in high stress missile enviroments or in abnormal environments of crush, impact and fire.

Another object of the present invention is to provide a warhead enable switch which is not sensitive to spurious electrical signals.

Another object of the present invention is to provide a warhead enable switch which is responsive only to a plurality of unique input signals.

Another object of the present invention is to provide a warhead enable switch which requires 3 electrical input signals and is mechanically resettable in the event there is a loss of any one of three signals.

A further object of the present invention is to provide a warhead enable switch which will fail-safe rather than fail-arm in the event that there is a loss of an electrical input signal.

For a better understanding of the present invention, together with other and further objects thereof, reference is made to the following descriptions taken in connection with the accompanying drawings.

BRIEF DESCRIPTION OF THE DRAWINGS

Throughout the following description like reference numeral are used to denote like parts of the drawings.

DESCRIPTION OF THE PREFERRED EMBODIMENTS

Figure 1:
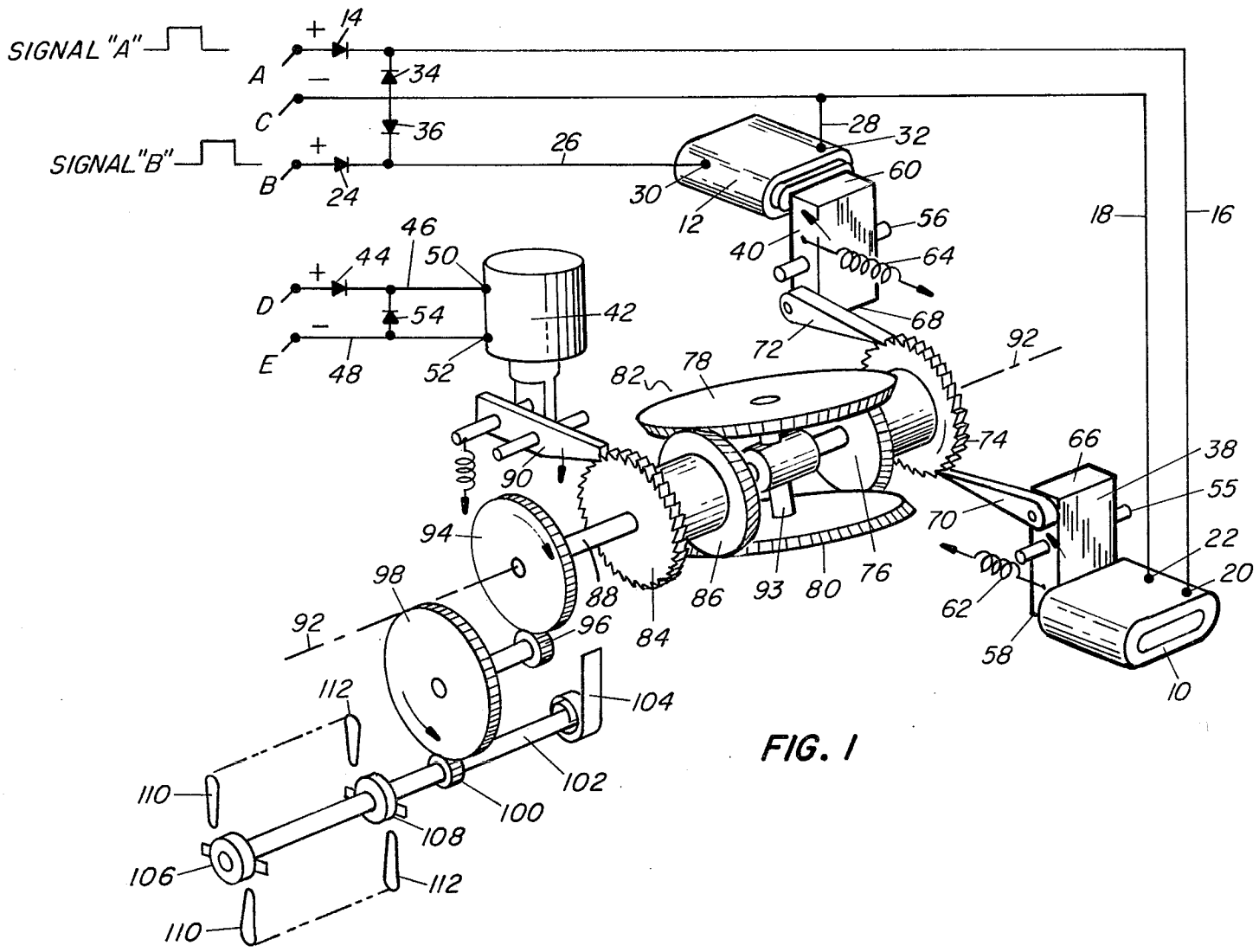
FIG. 1 is an isometric exploded view of the warhead enable switch with electrical schematic connection thereto.

Referring now to FIG. 1, the driving mechanism comprises a first solenoid 10 and a second solenoid 12. A first pulsating DC signal "A" is impressed across terminals AC through first series diode 14 via electrical conductor 16 and 18 to input terminal 20 and 22 of first solenoid 10, respectively. In a similar manner, a second electrical pulsating DC signal "B" which is 180° out of phase with Signal "A" is impressed across terminals BC through second series diode 24 via electrical conductors 26 and 28 to second solenoid input terminal 30 and 32 respectively. The series diodes 14 and 24 assure that the incoming input singals "A" and "B" are of correct polarity.

Terminal C is a common return electrical conductor for the first solenoid 10 and the second solenoid 12. Diodes 34 and 36, which are electrically connected in parallel with the coils of solenoids 10 and 12 respectively, are used to keep the peak inverse voltage low when the magnetic fields on the coils collapse. In addition, the diodes 34 and 36 shunting the step solenoids 10 and 12 respectively, delay the collapse of the magnetic fields thereby allowing the first and second solenoid clappers 38 and 40 respectively to release slowly. In this manner, second step solenoid clapper 40 is pulled in before the first solenoid clapper 38 is actually released. A lock solenoid 42 is connected to a DC enabling source at terminals D and E through a third series diode 44 via electrical conductors 46 and 48 to lock solenoid input terminals 50 and 52 respectively. A third shunt diode 54 is connected in parallel with the coil of lock solenoid 42 and acts to keep the peak inverse voltage low across the coil of solenoid 42. Clappers 38 and 40 of stepping solenoids 10 and 12 respectively are rotatably positioned on pivots 55 and 56 and have their first ends 58 and 60 biasedly held by first and second tension springs 62 and 64 respectively. The other ends 66 and 68 of clappers 38 and 40, respectively, rotatably hold first and second pawls 70 and 72, each of which in turn engage the toothed edge of a first ratchet wheel 74. First ratchet wheel 74 is axially aligned and fixedly pinned to a first bevel gear 76 which meshes with the top gear section 78 and bottom gear 80 of a differential assembly 82. Bevel gear 76 is rotatably supported on one end of differential shaft 88. A second ratchet wheel 84 is pinned to a seond bevel gear 86 which also meshes with the top and bottom differential gear sections 78 and 80 respectively. The hub of differential 82 is pinned to differential output shaft 88. When the second ratchet wheel 84 is held fast by the biasedly rotatably positioned lock lever 90 and the first ratchet wheel 74 is rotated, the differential 82 will slowly rotate about the longitudinal axis 92 of differential shaft 88. When the second ratchet wheel is not held in a locked position by the lock lever 90 of lock solenoid 42, the rotation of first ratchet wheel 74 and first bevel gear 76 will merely cause the second ratchet wheel and second bevel gear 86 to rotate on differential output shaft 88 and the top and bottom gears of 78 and 80 to rotate about differential pivot shaft 93 without causing the whole differential 82 to rotate. Pivot shaft 93 is fixedly pinned to the differential output shaft 88 in such manner so that the longitudinal axis of the differential output shaft 88 is normal to and lies in a plane which passes through the longitudinal axis of the pivot shaft 93. A gear train 94, 96, 98 meshes with an output shaft gear 100 which is pinioned to a spring biased output shaft 102. When the device is in a "safe" position, the tension on spring 104 is sufficient to create a torque on output shaft 102 which holds rotor blades 106 and 108 in an open position. When the output shaft 102 rotates 90° the rotor switch arms 106 and 108 make electrical contact with switch output terminals 110 and 112 respectively thereby placing the switch in an "arm" position.

Figure 2:
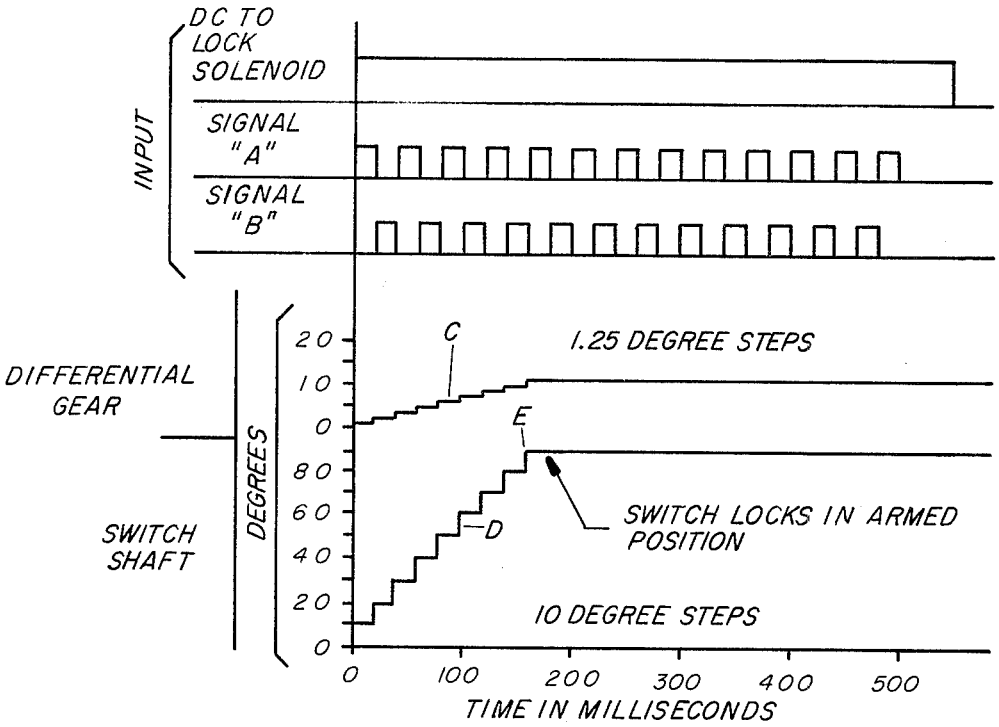
FIG. 2 is a composite graph showing the input signals, differential gear and switch shaft movement plotted on the ordinate as a function of time in milliseconds plotted on the abscissa for normal electrical inputs.

Referring now to FIGS. 1 and 2 in operation, when two pulsating DC, 180° out of phase electrical signals "A" and "B" are applied to first and second solenoids 10 and 12, respectively, and a DC voltage is simultaneously applied to lock solenoid 42, the pulsed actuation of solenoid 10 and 12 drives the first ratchet wheel 74 incrementally via drive pawls 70 and 72. Each solenoid 10 and 12 must be pulsed alternately otherwise the first ratchet wheel 74 will not advance because of the solenoid and ratchet tooth juxtaposition. The first ratchet wheel 74 is machined with 72 teeth or 5° per tooth. The solenoid pawls 70, 72 are placed approximately 182.5° apart so that each pawl stroke is slightly in excess of 2.5°. Consequently, a single solenoid cannot stroke the ratchet wheel 74 any further than 2.5°. Each stroke of the pawls 70, 72 simply advances the first ratchet wheel 74 sufficiently to allow the opposite solenoid to engage its mating ratchet tooth on actuation. Deenergization for instance of the first solenoid simply causes pawl 70 to disengage with the tooth of ratchet wheel 74. If the second solenoid 12 is not energized to pick up the ratchet tooth of ratchet wheel 74 placed in position by the solenoid 10, before the first solenoid 10 releases the ratchet tooth, the differential 82 and differential output shaft 88 advanced by the first solenoid 10 will reset to its initial "safe" position as shown in FIG. 1. In the event that the first solenoid 10 is not released, the second solenoid 12, is unable to advance the ratchet drive wheel 74. When there is normal alternate indexing of the ratchet 74 caused by properly phased input signals "A" and "B" and a continuous DC lock signal, the first ratchet wheel 74 input to the differential 82 will produce 1.25° output increments from the differential output shaft 88 as indicated by curve C on FIG. 2. As long as at least one solenoid of the first and second solenoids is always engaged, the differential 82 will not be returned to a zero position. However, for a solenoid to advance the first bevel gear 76, the other solenoid must release. With both solenoids 10 and 12 on simultaneously, the first ratchet wheel 74 will lock up so that it cannot rotate. However, when the second ratchet wheel 84 is in its locked position and the first ratchet wheel 74 steps, the differential assembly 82 will, through the differential output shaft 88, drive the switch output shaft 102. When the switch shaft 102 rotates 90 degrees as shown by Curve D at point E on the curve, the rotor switch arms 106 and 108 will make contact with switch output terminals 110 and 112, thereby placing the switch in an "armed" position. The differential assembly 82 accepts two inputs and provides a single output. In the present embodiment one input is the solenoid indexing mechanism comprising the first and second solenoid 10 and 12, biased clappers 38 and 40, pawls 70 and 72, first ratchet wheel 74 and bevel gear 76, and the second input is te DC lock solenoid 42 with biased lock lever 90. In order to obtain an output rotation of the output switch shaft 102, both inputs must be locked or operated in the on mode. Should one input be "free" to rotate, the differential output shaft 88 will remain stationary and the "free" input will free until it is locked, in which case the output shaft will then respond to input torques.

Figure 3:
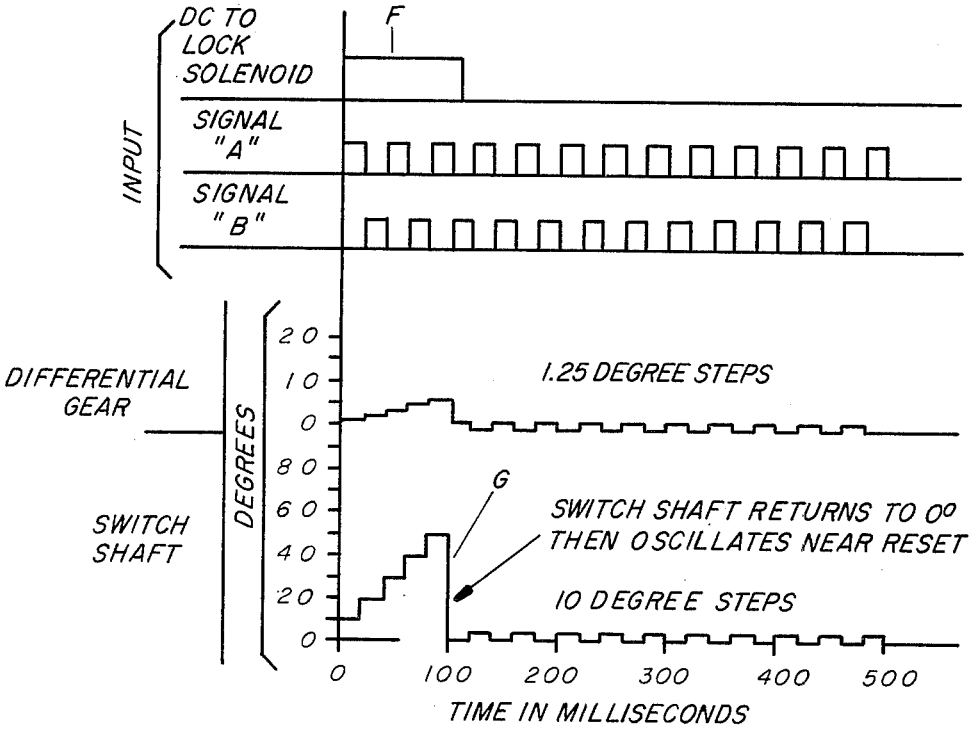
FIG. 3 is a composite graph for parameters similar to those shown in FIG. 2 with abnormal input, for example, the loss of DC voltage to a lock solenoid at approximately 100 milliseconds after initiation of the input signals.

Referring now to FIGS. 1 and 3, curve F of FIG. 3 graphically shows that whenever DC power is removed from the lock solenoid 42, before the rotor switch arms 106 and 108 are locked in an "armed" position, the switch output shaft 102 will return to the zero safe position as shown by curve G. The differential 82 will oscillate 1.25 % around the zero position since the second ratchet wheel 84 and second bevel gear 86 are now free spinning.

Figure 4:
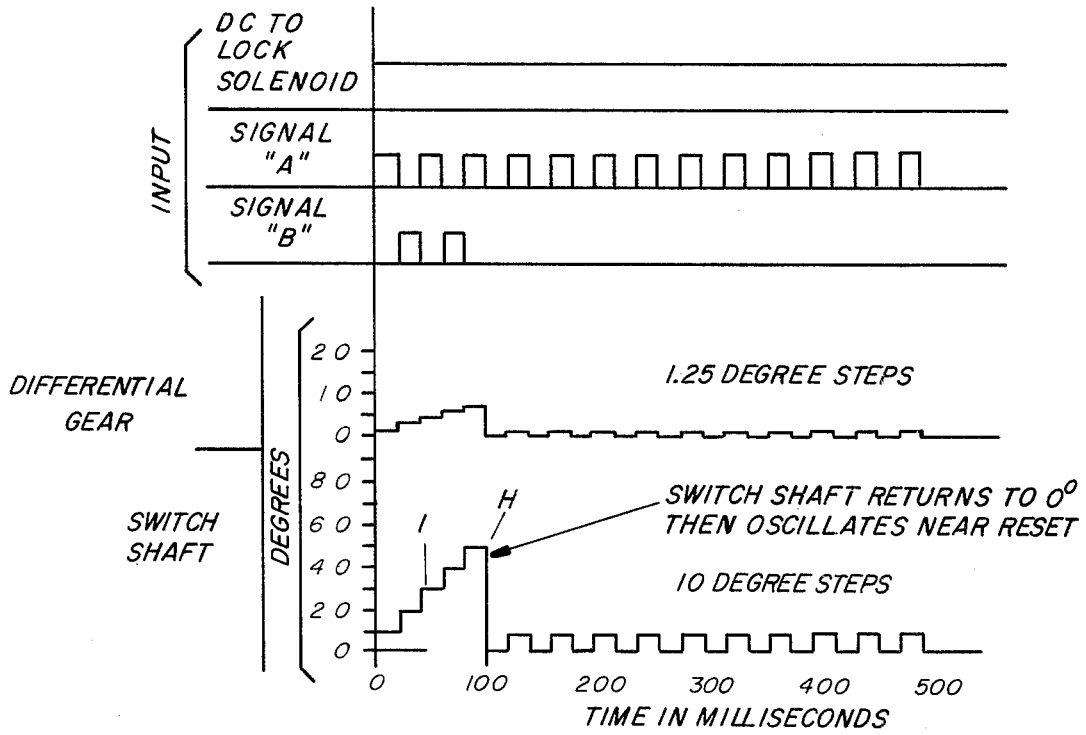
FIG. 4 is a composite graph similar to graph shown in FIG. 2 with abnormal input, the loss of signal "B" after approximately 80 milliseconds.

FIG. 4 shows the free spinning condition graphically where there is a period during which the "B" signal has failed and second solenoid 12 is not energized. Under this condition, even though the second ratchet wheel 84 and second bevel gear 86 are in their locked position, the differential 82 through gearing to the differential output shaft 88 is spring returned to the zero position as shown by points H on curve I.

Figure 5:
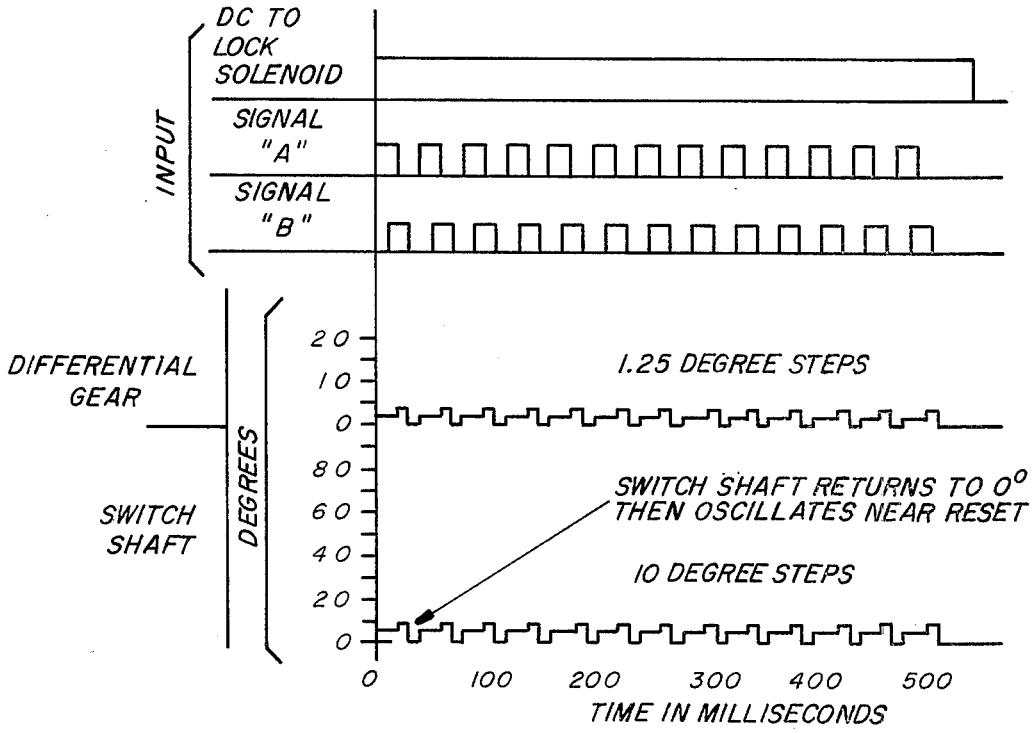
FIG. 5 is a composite graphical representation similar to the graphical representation shown in FIG. 2 with abnormal input, improper phase relationship between input signal "A" and input.

FIG. 5 illustrates the free spinning condition graphically caused by a phasing problem where signals "A" and "B" overlap. Whenever there is no power on either the first and second solenoids 10 and 12 respectively, the output shaft return spring 104 will return the output switch shaft 102 to its initial "zero" position or "safe" position as shown in FIG. 1. In one embodiment of the present invention an 8:1 gear train 94, 96, 98 connects the differential output shaft 88 to the spring loaded output shaft 102 which drives the two rotary switches 106 and 108 in 10° increments. Nine pulses of the first and second solenoids 10 and 12 are required to enable the switches 106 and 108 to rotate 90° from the "safe" unarmed position to the "armed" or enabled position.

While there has been described and illustrated specific embodiment of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A warhead enable switch for safing and arming a missile warhead circuit under missile stress environments which comprises:

differential means for generating a single rotary output in response to a plurality of mechanical inputs;

dual solenoid drive means for providing a first mechanical input to said differential means;

solenoid locking means for providing a second mechanical input to said differential means;

series diode means electrically coupled to said solenoid drive means and said solenoid locking means permitting electrical signals of only a specific polarity to initiate said solenoid drive means;

shunt diode means electrically coupled in parallel with the coils of said solenoid means said solenoid locking means for reducing the peak inverse voltage on the coils of said solenoid drive means and said solenoid locking means when the magnetic fields on said coils collapse;

spring biased rotary switch means for placing said missile in an "armed" position when each of said dual solenoid drive means and said solenoid lock means have received a proper input signal thereto, and for returning said missile to a zero "safe" position when either of said dual solenoid drive means and said solenoid lock means receive an improper input signal; and gearing means for mechanically coupling said rotary switch means to the rotary output of said differential means.

2. A warhead enable switch as recited in claim 1, wherein said differential means comprises:

a top gear;

a pivot shaft rotatably supporting said top gear on one end of said pivot shaft;

a bottom gear rotatably supported on the other end of said pivot shaft, and;

a differential output shaft fixedly pinned to said pivot shaft so that the longitudinal axis of said differential output shaft is normal to and lies in a plane passing through the longitudinal axis of said pivot shaft.

3. A warhead enable switch as recited in claim 2, wherein said dual solenoid drive means comprises:

a first solenoid having coil input terminals electrically connected in series with said series diode means and in parallel with said shunt diode means;

a first solenoid clapper having a first end and a second end, said clapper being rotatably positioned so that said first end is proximate to the coil of said first solenoid;

a first clapper tension spring fixedly attached to the first end of said first clapper, said first tension spring pulling the first end of said first clapper in a direction away from said first solenoid;

a first pawl rotatably supported on the second end of said first clapper;

a first ratchet wheel having a peripheral toothed edge in contact and alignment with said first pawl;

a first bevel gear axially aligned and fixedly pinned to said first ratchet wheel, said first bevel gear being rotatably supported on one end of said differential output shaft so that the teeth of said bevel gear are in contact with the teeth of said top and bottom gears of said differential means;

a second solenoid having coil input terminals electrically connected in series with series diode means and in parallel with said shunt diode means;

a second solenoid clapper having a first end and a second end, said second clapper being rotatably positioned so that said first end is proximate to the coil of said second solenoid;

a second clapper tension spring fixedly attached to the first end of said second clapper, said second tension spring pulling the first end of said second clapper in a direction away from said second solenoid; and a second pawl rotatably supported on the second end of said second clapper, said second pawl in contact with the teeth of said ratchet wheel, said second pawl being disposed 182.5° apart from said first pawl, each of said first and second pawls having a pawl stroke slightly greater than 2.5° said first pawl stroke advancing said first ratchet wheel sufficiently to allow said second pawl to engage the next tooth of said first ratchet wheel and vice versa when each of said solenoids receive a proper input signal.

4. A warhead enable switch as recited in claim 3, wherein said solenoid locking means comprises:

a lock solenoid having coil input terminals electrically connected in series with said series diode means and in parallel with said shunt diode means;

a biased rotatably disposed lock lever operatively connected to said lock solenoid;

a second ratchet wheel rotatably positioned on said differential output shaft, said second ratchet wheel having teeth thereon which engage said lock lever when said lock solenoid is energized; and a second bevel gear axially aligned and fixedly attached to said second ratchet wheel, the teeth of said second bevel gear being in contact with the teeth of said top and bottom gears of said differential means, wherein when said second ratchet wheel is held in a locked position by said lock lever and said first second pawls by said first and second solenoids respectively, said differential means rotate causing said differential output shaft to drive said gearing means causing said switch means to change from said "safe" position to said "armed" position.

* * * * *